US006157729A

United States Patent [19]

LeBlanc

[11] Patent Number: 6,157,729

[45] Date of Patent: Dec. 5, 2000

[54] ANTI-THEFT BOAT SPEAKER BRACKETS

[76] Inventor: David A. LeBlanc, 497 Sconticut Neck Rd., Fairhaven, Mass. 02719

[21] Appl. No.: 09/163,172

[22] Filed: Sep. 30, 1998

[51] Int. Cl.[7] ..... H04R 1/02

[52] U.S. Cl. ..... 381/386; 381/87; 381/389; 381/334; 181/141

[58] Field of Search ..... 381/87, 388, 395, 381/387, 390, 386, 334, 336; 181/141

[56] References Cited

U.S. PATENT DOCUMENTS

| | | | |
|---|---|---|---|
| 4,210,784 | 7/1980 | Phillips | 381/301 |
| 5,048,089 | 9/1991 | Moore | 381/87 |
| 5,321,760 | 6/1994 | Gray | 381/86 |
| 5,591,946 | 1/1997 | Jehle et al. | 181/141 |
| 5,608,806 | 3/1997 | Hinojosa | 381/86 |
| 5,771,305 | 6/1998 | Davis | 381/386 |

*Primary Examiner*—Forester W. Isen
*Assistant Examiner*—Brian Tyrone Pendleton
*Attorney, Agent, or Firm*—Patent & Trademark Services; Thomas Zack; Joseph H. McGlynn

[57] ABSTRACT

A speaker mounting assembly for use on a boat. The assembly consists of a rigid elongated speaker support bracket on which two interfacing boat engaging members are fixed opposite the speaker. The boat engaging members have a hole through their mid portion and are pivotally joined together each of their sides with a component of the boat, such as a rail, compressed between them. At their other side these two boat engaging members are fixed to the boat by a through bolt extending through both members. At the upper portion of one of the engaging members is a lever arm having an internally threaded hole that fits on the top of the through bolt and, when compressed, is used to retain the members to the boat. Alternately, the lever arm may be used to adjust the compressive force of the boat engaging members with respect to the engaged boat component on which mounted. By reducing the compressive force by turning the lever arm, the upper boating engaging member may be pivoted backwards and released thus releasing the speaker support assembly from the boat for storage and safe keeping. Provisions is also made for the side adjustment of the speaker's mounting bracket.

8 Claims, 2 Drawing Sheets

FIG. 1
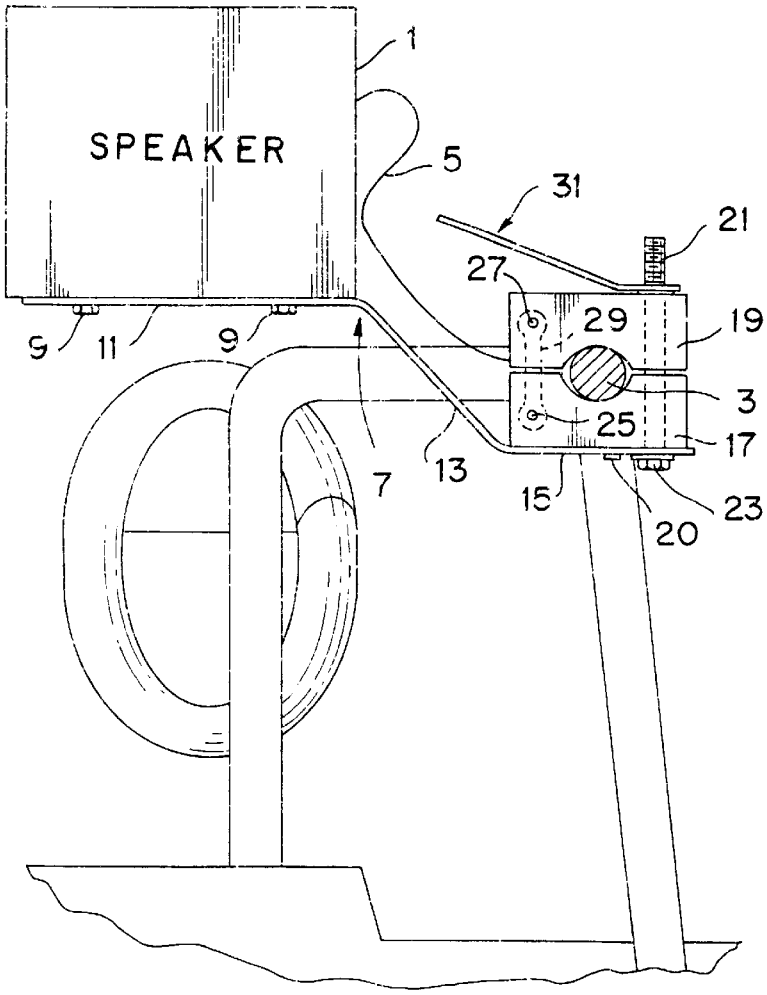
FIG. 4(a)
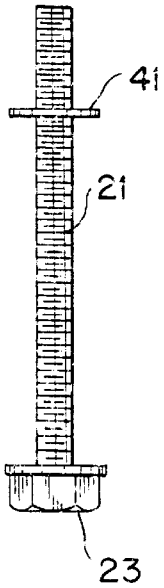
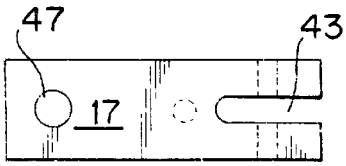
FIG. 4(f)
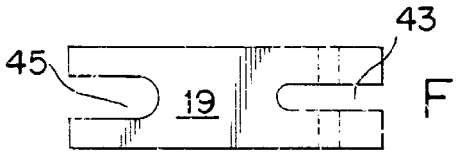
FIG. 4(b)
FIG. 4(g)
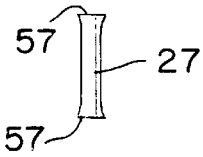
FIG. 4(e)
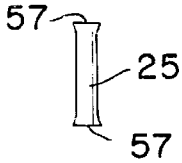
FIG. 4(c)
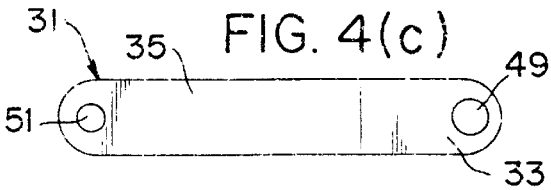
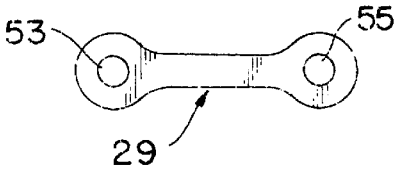
FIG. 4(d)

ANTI-THEFT BOAT SPEAKER BRACKETS

BACKGROUND OF THE INVENTION

Protecting items from being stolen has become a full time job. The array of devices used to obtain protection includes a great many items such as alarms, locks and related items. One area where such property protection items have been used extensively is in the boating industry where the boats are left unattended for long periods of time thereby providing an inviting and easy target for would be thieves. If the particular item to be protected can be placed under lock and key inside the boat or removed and taken home the likelihood of theft is greatly reduced or eliminated.

Of particular concern for protection are expensive audio speakers that are usually mounted outside the boat's open deck and therefore easily seen and removed by a would be thief. The present invention addresses this potential theft problem of boat audio speakers by providing for a speaker mounting assembly, all as set forth hereafter, that can easily mount a speaker firmly to the boat and yet within a matter of seconds, allow the speakers to be safely and easily disconnected from where mounted and thereafter permit them to be either stored below deck under lock and key or taken to a safe remote location.

DESCRIPTION OF THE PRIOR ART

Easily removed speaker assemblies are known. For example, in U.S. Pat. No. 5,048,089 to Moore a portable removably attached speaker assembly for a vehicle is disclosed having handles.

In the Gray reference (U.S. Pat. No. 5,321,760) a retractable speaker assembly for an automobile is disclosed having means for remotely controlling the rotation of and directing the orientation of a speaker housing to either the left or right side of the automobile's interior.

The Jehle et al. patent (U.S. Pat. No. 5,591,946) discloses a folding acoustic speaker container that can be stored in the rear of a vehicle seat.

And in the Hinojosa invention (U.S. Pat. No. 5,608,806) an audio speaker assembly for a vehicle is mounted in the vehicle's roll bars in a weather tight configuration.

The present invention relates a mounting assembly for audio speakers that is specifically designed for use on a boat all as more fully set forth in this specification.

SUMMARY OF THE INVENTION

This invention relates to a speaker mounting assembly for use with a boat. The assembly consists of a adjustable elongated bracket on which two interfacing boat engaging members are fixed. The boat engaging members have a hole through their mid portion and are pivotally joined together on one side. At the other side these members are fixed to the boat by a through bolt extending through both members. At the upper portion of one of the engaging members is a handle having an internally threaded hole that fits on the through bolt and is used to retain the boat engaging members together to the boat.

It is the primary object of the present invention to provide for an improved easily mountable and detachable speaker mounting assembly.

Another object is to provide for such an assembly used for a boat wherein a single bolt mounted lever can disengaged from the boat engaging members and permit the speaker and their mount to be be removed therefrom.

These and other objects and advantages of the present invention will become apparent to readers from a consideration of the ensuing description and the accompanying drawings.

BRIEF DESCRIPTION OF THE DRAWINGS

FIG. 1 is a side view of the invention's preferred embodiment showing it mounting a speaker to a boat's railing.

FIGS. 4(*a*)–(*g*) each show one or more different views of the individual additional components of the FIG. 1 preferred embodiment.

DESCRIPTION OF THE PREFERRED EMBODIMENT

Figure 2:
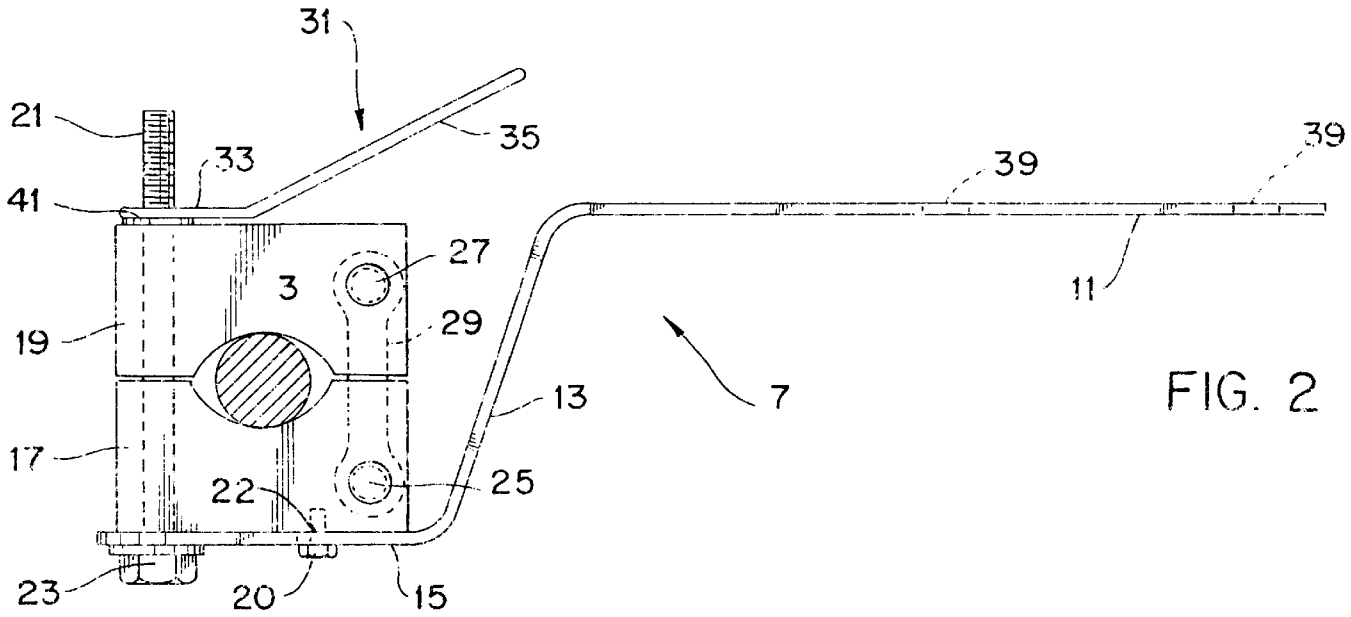
FIG. 2 is a side enlarged view of the FIG. 1 speaker mounting assembly.

FIG. 1 is a side view of the invention's preferred embodiment showing it mounting an audio speaker 1 to a boat's railing 3. Extending from the speaker is a power cord 5 which is connected to a source of electrical power on its other (not shown) end. Supporting the horizontally disposed speaker 1 on its lower underside is the elongated rigid bracket member 7 which has a first section 11 with two through bolts 9 that go through the bracket to engage the speaker's bottom and fix the bracket to the speaker. This bracket's first section 11 is cantilevered and has a free end. At the end opposite its free end, the cantilevered horizontally disposed bracket section 11 is attached to a second bracket section 13 which bends downwardly and backwardly in the direction of the mounting rail 3. Generally parallel to section 11 and joined to second bracket section 13 is the joined third bracket section 15. This latter third section acts to horizontally support from underneath the two rail engaging members 17 and 19. An adjustable compressive member consisting of the large externally threaded upright bolt 21 extends through both engaging members 17 and 19 with its enlarged lower bolt head 23 bearing against the under side of member 15. Two horizontally disposed and spaced mounting pins 25 and 27 extend, respectively, through the depth of engaging members 17 and 19. A supporting hourglass shaped member 29 is within the engaging members 17 and 19 and is used to mount the two spaced pins 25 and 27. The member 29 extends through the open break between the lower and upper rail engaging members 17 and 19 to join them together. Extending upwardly from the top of bolt 21 is the locking arm 31 used to maintain the bolt in place as the bolt extends through the rail engaging members 17 and 19.

FIG. 2 is a side enlarged view of the FIG. 1 speaker mounting assembly without showing the mounted speaker 1. In this reverse side view from FIG. 1, the hourglass pins mount 29 are within the body of the rail engaging members 17 and 19 and therefore are shown in dotted line format. The rigid locking arm 31 has a lower bolt engaging threaded through hole in section 33. The joined bent longer free end lever section 35 is inclined upwardly as indicated. A protective rubber or plastic covering may cover most of the outer surface of section 35 to permit a user to hold the lever and rotate lever arm 31 around bolt 21. Depending on the direction of rotation, the arm 31 can be used to adjust the amount of compressive force applied by the bolt to the two boat engaging members 17 and 19 . Thus, one could either tighten the arm on the bolt 21 and thereby retain the speaker mount to the rail or one could loosen the amount of compressive force towards zero and permit the speaker mount assembly to be removed from the rail 3 as the bolt end of upper rail engaging member 19, when at or near zero compression, can be pivoted upwardly on upper opposite side mounting pin 27 by pushing downwardly on the free end of lever arm 31.

A bolt 20 can extend upwardly into and through brace section 15 through a side adjustment hole 22 (shown in dotted line format) and into a lower female threaded hole in the boat engaging members 17. which receive the two speaker attaching bolts 9 of FIG. 1 that extend into the bottom of the speaker to fix the speaker to the bracket 7 . The vertical dotted lines indicate the approximate areas for the two bracket bends separating the three different bracket sections 11, 13 and 15 from each other as indicated previously.

FIGS. 4(*a*)–(*g*) each show one or more different views of the individual additional components of the FIG. 1 preferred embodiment in more detail. The side view of the threaded bolt 21 shown in FIG. 4(*a*) depicts an upper bolt mounted washer 41 which can bear against and engage the holed lower portion of the lever section 33. Since, the lever's bolt receiving hole 49 (see FIG. 4(*c*)) is threaded where is engages the threads on bolt 21, by tightening the lever 31 on the bolt the washer 41 is forced down into the top of member 19 to compress the two members 17 and 19 together around the enclosed boat's interposed rail 3.

Figure 3:
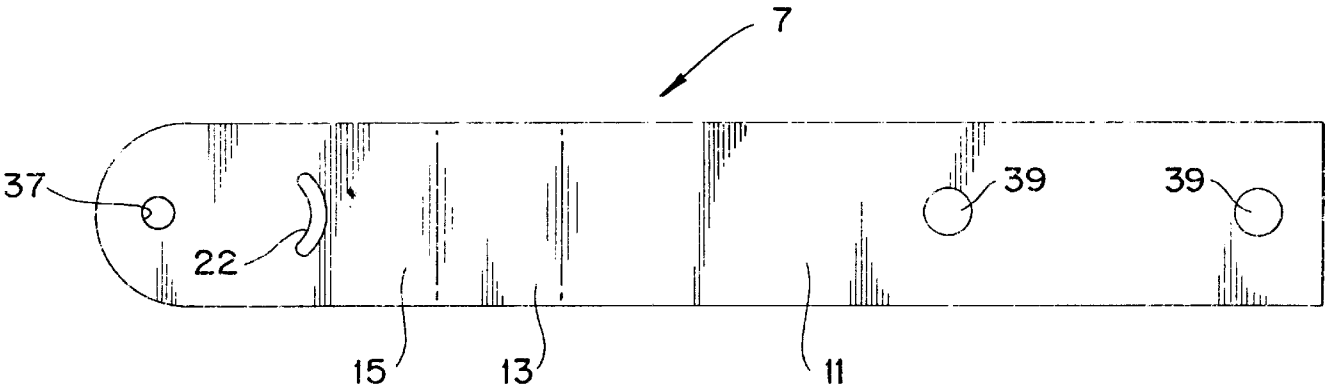
FIG. 3 shows a top view of the main mounting bracket used in the preferred embodiment.

FIGS. 4(*b*) and (*f*) show top views of the two spaced rail engaging members 19 and 17, respectively . The two U-shaped opened cut outs 43 receive the hour glass pins for mount 29 and are vertically aligned when assembled as in FIGS. 1–2 while the other U-shaped opened cut 45 (see FIG. 4(*b*) in upper engaging member 19 receives the top part of the threaded bolt 21. The lateral dotted lines extending to intersect the cut outs 43 indicate the through holes in the two rail engaging members that are used to receive the two spaced horizontal pins 25 and 27 on their pin mount 29. The hole 47 in the lower rail engaging member 17 (see FIG. 4(*f*) has internal female threads that threadedly receive the lower part of bolt 21 threads to hold member 17 in place. Hole 47 is vertically aligned with the hole 37 in bracket section 15 (see FIG. 3) and the cut out portionn 45 in upper member 19 (see FIG. 4(*b*)) when assembled as shown in FIGS. 1 and 2.

FIG. 4(*c*) is a top view of the locking lever arm 31 shown in side views in both FIGS. 1 and 2. The lower internally threaded hole 49 fits on the threaded upright bolt 21 and the opposite end smaller hole 51 in section 35 can be used to insert a screwdriver or other rigid elongated member into the arm 31 to assist in tightening the arm 31 or loosening a previously tightened arm 31.

FIG. 4(*d*) is a side view of the hourglass pins mount 29 previously described. Two spaced opposite end holes 53 and 55 in the mount receives the pins 25 and 27 which extend into the two rail engaging members 17 and 19. These pins permit a pivotal movement of the upper engaging member 19 as it is lifted up in its cut out 45 when a person desires to release the engaging members from the rail when the compressive pressure of the arm 31 is released.

FIG. 4(*e*) is a top view of the lower pin member 25, shown in a side view in FIGS. 1 and 2 while FIG. 4(*g*) is a top view for upper pin member 27 . Pin 25 is a solid cylinder, such as a stainless steel cylinder, that fits into the lower hole space that extends widthwise through the lower rail engaging member 17 and its respective lower cut out 43 portion. Similarly, in FIG. 4(*g*), the shown top pin 27 also is a similar solid cylinder, such as a stainless steel cylinder, fits into the spaced hole that extends widthwise through the upper rail engaging member 19 and its respective upper cut out 43 portion. To insure that the two pins 25 and 27 do not become dislodged from their respective mounts in members 17 and 19, their four pin ends 57 may have enlarged opposite end diameters that are greater than the diameters of the pins' sections that extend through their respective member 17 and 19 engaging holes.

In use, to disengage the mounted audio speaker or speakers from their respective mounts, one would rotate the arm 31 to loosen the compressive hold of the bolt on the two members 17 and 19. When sufficiently loosened, the upper member 19 can be pivoted backward on its pin 27 mount and released which releases the complete speaker mount assembly from the boat's rail 3. After disconnecting the electrical hook up for the speaker, the separated speaker may be stored below deck and locked up or taken home. Thus, once the speaker is out of clear sight there is considerably less likelihood that a random thief will see or take the moved and disconnected from the rail speakers.

Variations to the described embodiment are clearly possible. The two boat engaging members 17 and 19 need not be connected to a boat's railing. They may be connected to any other firm convenience boat component on which they may fit such as a boat's stanchion. All mounting components should be constructed of a weather resistant materials such as stainless steel or plastic.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A speaker mounting assembly for use on a boat comprising:

two boat engaging members pivotally joined together at one of their ends, said members being fixedly joined together at a second of their ends with a component of the boat compressively mounted between said two members;

a speaker mounting bracket fixed to one of said two engaging members and extending therefrom to vertically support a speaker;

an adjustable compression member mounted to said two boat engaging members at their second ends for controlling the compression of the two members together against said component of the boat on which mounted; and an arm mounted on said compression member and extending therefrom, said arm being capable of adjusting the amount of compressive force applied by said compression member to the boat engaging members and the component of the boat on which said members are mounted.

2. The speaker mounting assembly as claimed in claim 1, wherein said two boat engaging members are pivotally joined together by two spaced pins extending substantially through the members.

3. The speaker mounting assembly as claimed in claim 2, wherein said adjustable compression member is an externally threaded bolt having a enlarged head on the lower side of one of the two engaging members.

4. The speaker mounting assembly claimed in claim 3, wherein said engaging members having cut out portions in which said two spaced pins extend across.

5. The speaker mounting assembly as claimed in claim 4, also including a mounting for said two spaced pins mounted within the cut outs portions of the two engaging members.

6. The speaker mounting assembly as claimed in claim 5, wherein said an arm mounted on said compression member has internal threads that mesh with the external threads of the bolt.

7. The speaker mounting assembly as claimed in claim 6, also including a through side adjustment hole in said speaker mounting bracket in which an adjustable fastener extends, said fastener extending into one of said adjustable compression members whereby a speaker mounted on the mounting bracket may be moved from side to side by loosening the fastener.

8. The speaker mounting assembly as claimed in claim 7, wherein said two boat engaging members consist of an upper member and a lower member with said lower member having a receptor hole for said fastener which extends in the hole to thereby permit the speaker mounting bracket to be moved side wise relative to the two boat engaging members.

* * * * *